US007469984B2

(12) United States Patent
Niioka

(10) Patent No.: US 7,469,984 B2
(45) Date of Patent: Dec. 30, 2008

(54) METHOD OF DETERMINING THRESHOLD OF DETECTION FOR EDGE OF PRINTING MEDIUM, AND PRINTER OPERABLE TO EXECUTE THE SAME

(75) Inventor: Koji Niioka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 77 days.

(21) Appl. No.: 11/601,320

(22) Filed: Nov. 16, 2006

(65) Prior Publication Data

US 2007/0109338 A1 May 17, 2007

(30) Foreign Application Priority Data

Nov. 16, 2005 (JP) ..... 2005-331444

(51) Int. Cl.
*B41J 29/38* (2006.01)

(52) U.S. Cl. ..... 347/14; 347/19; 347/116

(58) Field of Classification Search ..... 347/7, 347/16, 19, 101, 104
See application file for complete search history.

(56) References Cited

U.S. PATENT DOCUMENTS 6,945,721 B2 * 9/2005 Sato ..... 400/708
7,279,695 B2 * 10/2007 Oguri ..... 250/559.36

FOREIGN PATENT DOCUMENTS

JP 2003-260829 9/2003
JP 2004-351898 12/2004

* cited by examiner

*Primary Examiner*—Thinh H Nguyen
(74) *Attorney, Agent, or Firm*—John J. Penny, Jr.; Edwards Angell Palmer & Dodge LLP

(57) ABSTRACT

A liquid ejecting head is operable to eject liquid toward a target medium. A platen opposes to the liquid ejecting head, and has a first region formed with a plurality of projections. A first detector includes a light emitter operable to emit light toward the platen and a light receiver adapted to receive light reflected from the platen. The first detector is operable to generate a detection signal in accordance with an amount of the light received by the light receiver. A controller is operable to obtain the detection signal at a plurality of positions in the first region to determine a threshold value of the detection signal for detecting whether the target medium exists on the platen.

15 Claims, 8 Drawing Sheets

METHOD OF DETERMINING THRESHOLD OF DETECTION FOR EDGE OF PRINTING MEDIUM, AND PRINTER OPERABLE TO EXECUTE THE SAME

BACKGROUND

1. Technical Field

The present invention relates to a method of determining a threshold of detection for an edge of a printing medium, and to a printer operable to execute the same.

2. Related Art

There have been known ink jet printers operable to perform printing on a prescribed printing medium such as paper. As such printers, there has been known a printer which comprises: a printing head operable to eject ink toward the printing medium; a carriage on which the printing head is mounted; a platen facing the printing head; and an optical sensor for detecting an edge of the paper in the moving direction of the carriage. Such a printer is disclosed in Japanese Patent Publication No. 2004-351898A (JP-A-2004-351898). In this printer, an optical sensor is fixed to a carriage and detection of the edge of the printing medium is performed with the movement of the carriage. Also, in the printer, a protrusion (rib) for supporting a printing medium during the printing operation is formed on the platen.

In general, in order to detect the edge of the printing medium, a prescribed threshold is set with respect to a detection signal from an optical sensor. As a method of setting the threshold, there has been proposed a method of setting a threshold on the basis of an output signal of an optical sensor when the optical sensor senses a protrusion formed on a platen. Such a method is disclosed in Japanese Patent Publication No. 2003-260829A (JP-A-2003-260829).

However, JP-A-2003-260829 is silent about how to specifically process the output signal of the optical sensor in order to set the threshold.

SUMMARY

It is therefore one advantageous aspect of the invention to provide a specific method of determining a threshold of detection for an edge of a printing medium and a printer operable to execute the method.

According to one aspect of the invention, there is provided a liquid ejecting apparatus, comprising:

a liquid ejecting head, operable to eject liquid toward a target medium;

a platen, opposing to the liquid ejecting head, and having a first region formed with a plurality of projections;

a first detector, including a light emitter operable to emit light toward the platen and a light receiver adapted to receive light reflected from the platen, the first detector operable to generate a detection signal in accordance with an amount of the light received by the light receiver; and a controller, operable to obtain the detection signal at a plurality of positions in the first region to determine a threshold value of the detection signal for detecting whether the target medium exists on the platen.

The projections may include first projections and second projections having smaller sizes than the first projections. The first regionmay be a region in which the second protrusions are formed.

The first projections may be adapted to support the target medium.

Each of the second projections may have a slope face.

Signal levels of the detection signal obtained at the plurality of positions may be different from each other.

The controller may be operable to determine the threshold value based on an average of the signal levels.

The liquid ejecting apparatus may further comprise: a carriage, operable to carry the liquid ejecting head and the first detector in a first direction; and a position detector, operable to detect a position of the carriage in the first direction to determine the plurality of positions.

The controller may be operable to detect whether a foreign substance exists on the platen, based on a signal level of the detection signal, and is operable to determine the threshold value except the signal level indicative of the existence of the foreign substance.

The plurality of positions may include a first position at which a first signal level of the detection signal is obtained and a second position at which a second signal level of the detection signal is obtained. The first signal level may be greater than a signal level of the detection signal obtained at a position shifted from the first position by a first distance in the first direction. The second signal level may be less than a signal level of the detection signal obtained at a position shifted from the second position by the first distance in the first direction.

According to one aspect of the invention, there is provided a method of determining a threshold value of a detection signal for detecting whether a target medium to which a liquid ejecting head ejects liquid exists on a platen which opposes the liquid ejecting head and has a first region formed with a plurality of projections. The method comprises:

emitting light from a light emitter to the platen;

receiving light reflected from the platen and generating a detection signal in accordance with an amount of the light received; and obtaining the detection signal at a plurality of positions in the first region to determine the threshold value.

The projections may include first projections and second projections having smaller sizes than the first projections. The first region may be a region in which the second protrusions are formed.

Signal levels of the detection signal obtained at the plurality of positions may be different from each other.

The threshold value may be determined based on an average of the signal levels.

The method may further comprise: carrying the liquid ejecting head, the light emitter and the light receiver in a first direction; and detecting a position of the carriage in the first direction to determine the plurality of positions.

The method may further comprise: detecting whether a foreign substance exists on the platen, based on a signal level of the detection signal; and determining the threshold value except the signal level indicative of the existence of the foreign substance.

The plurality of positions may include a first position at which a first signal level of the detection signal is obtained and a second position at which a second signal level of the detection signal is obtained. The first signal level may be greater than a signal level of the detection signal obtained at a position shifted from the first position by a first distance in the first direction. The second signal level may be less than a signal level of the detection signal obtained at a position shifted from the second position by the first distance in the first direction.

DETAILED DESCRIPTION OF EXEMPLARY EMBODIMENTS

Exemplary embodiments of the invention will be described below in detail with reference to the accompanying drawings.

Figure 1:
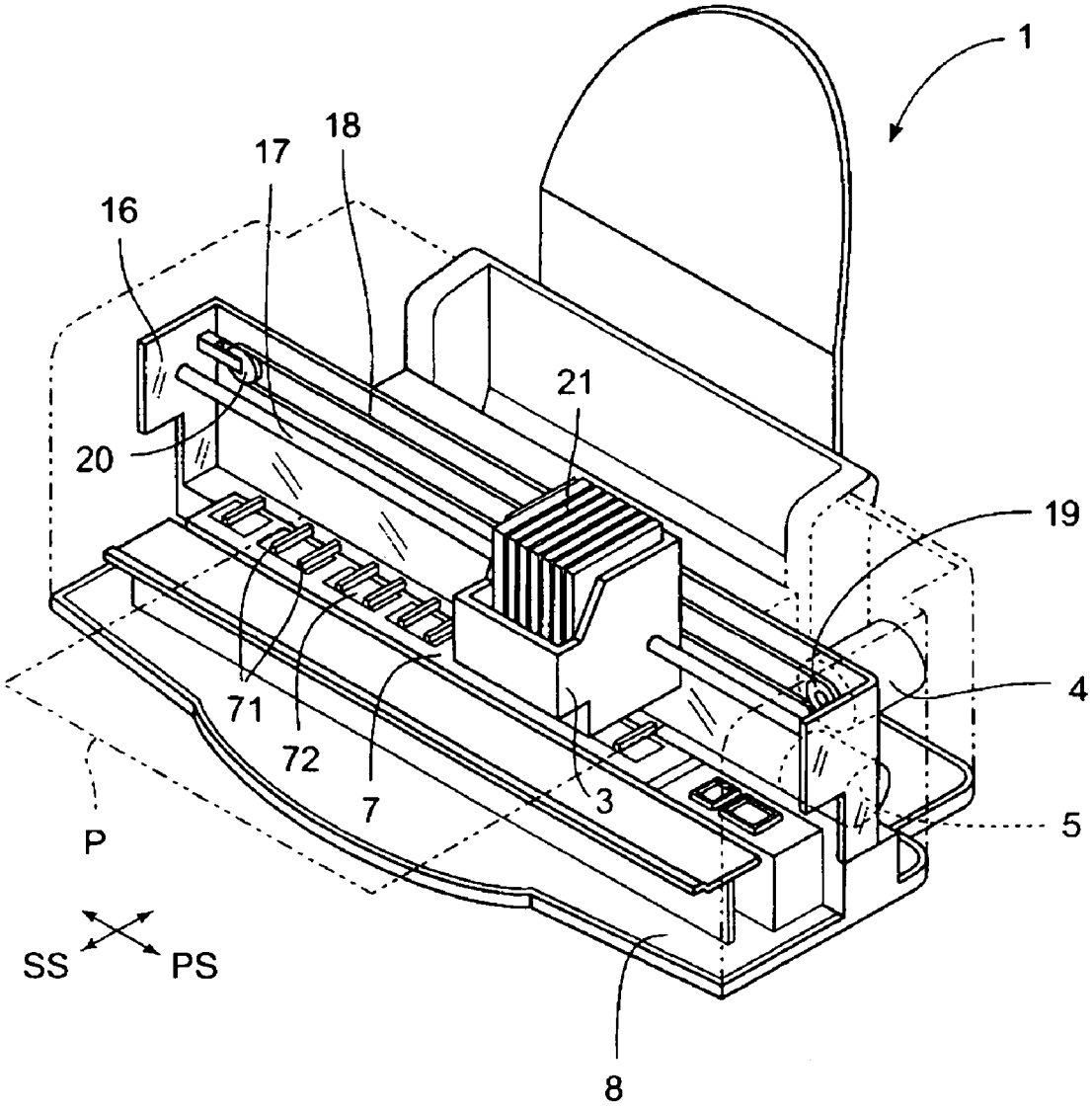
FIG. 1 is a perspective view of a printer according to one embodiment of the invention.
Figure 2:
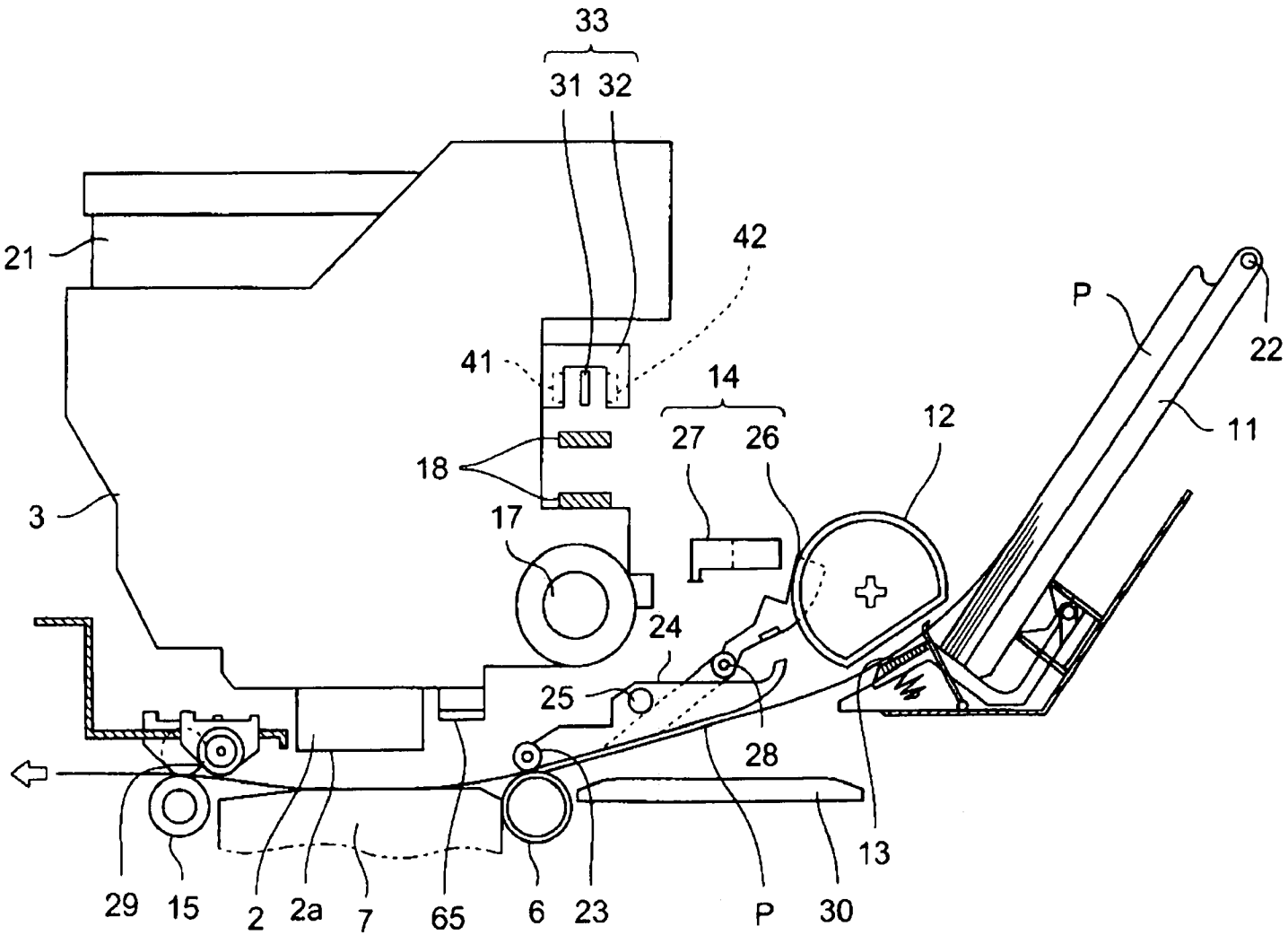
FIG. 2 is a schematic section view showing an internal configuration of the printer.
Figure 3:
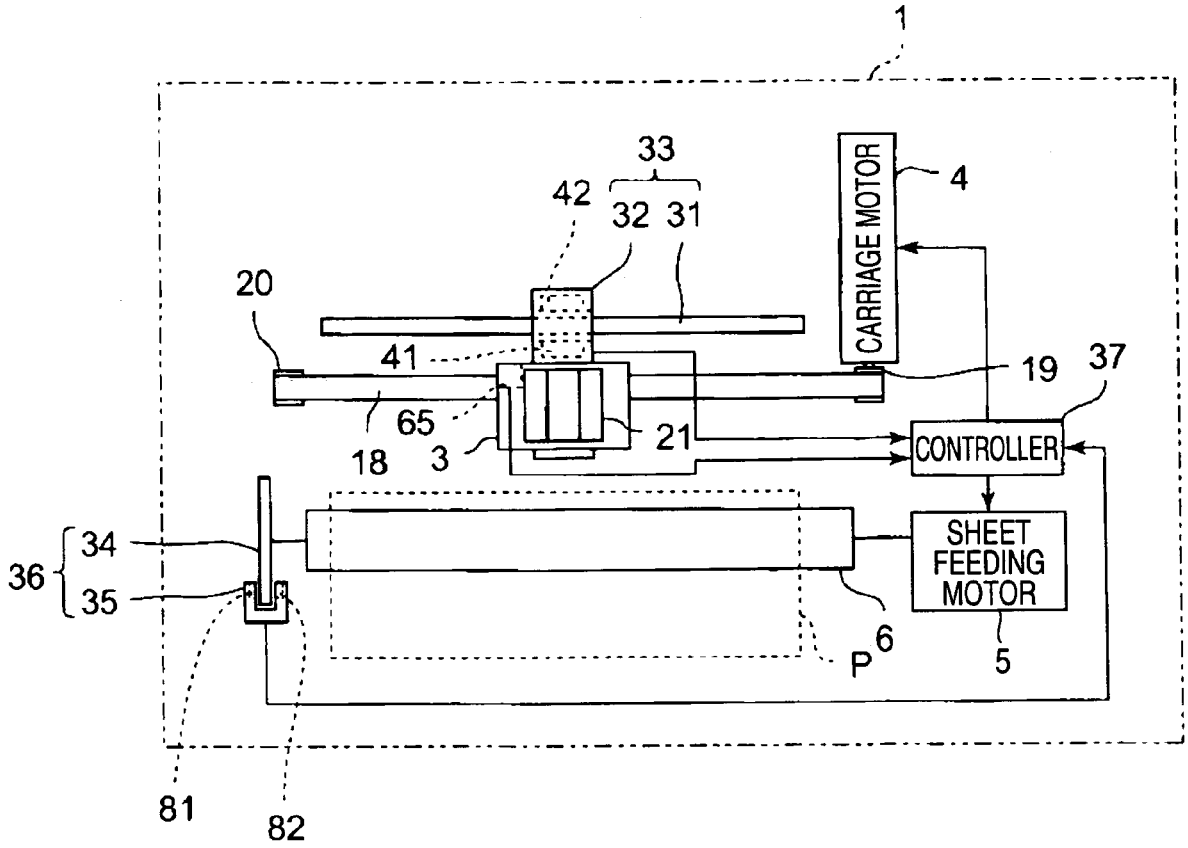
FIG. 3 is a schematic view showing detection mechanisms in the printer.

A printer 1 according to one embodiment of the invention is an ink jet printer operable to perform printing by ejecting ink onto a printing medium P. As shown in FIGS. 1 to 3, the printer 1 comprises: a carriage 3 on which a printing head 2 for ejecting ink drops is mounted; a carriage motor 4 for driving the carriage 3 in a primary scanning direction PS; a sheet feeding motor 5 for feeding the printing medium P in a secondary scanning direction SS; a sheet transporting roller 6 connected to the sheet feeding motor 5; a platen 7 opposing an ink ejecting face 2*a* of the printing head 2; and a main body chassis 8 on which those components are mounted. In this embodiment, both the carriage motor 4 and the sheet feeding motor 5 are DC motors. The printing medium P includes plain paper used to ordinary document printing, photographic paper used for photo printing, paper thicker than the plain paper or photographic paper, and transparent films, such as seals or OHP sheets.

As shown in FIG. 2, the printer 1 further comprises: a hopper 11 on which blank printing media P are mounted; a sheet feeding roller 12 and a separating pad 13 for feeding the printing media P mounted on the hopper 11 into the printer 1 in a one by one manner; a sheet guiding plate 30 for guiding a leading edge of the printing medium P fed from the hopper 11 to the sheet transporting roller 6; a sheet detector 14 for detecting the passage of the printing medium P fed from the hopper 11; and a sheet ejecting roller 15 for ejecting the printing medium P from the printer 1.

In the printer 1, the right side of FIG. 1 is a side closer to a home position HP of the carriage 3. On the other hand, the left side of FIG. 1 is a side closer to a turning point of a reciprocal movement of the carriage 3 which is referred to as an away position AP.

The carriage 3 can be moved by a timing belt 18 and a guide shaft 17 supported by a supporting frame 16 fixed to the main body chassis 8. That is, the timing belt 18 is wound under prescribed tension on a pulley 19 and a pulley 20 in a state where a portion of the timing belt 18 is fixed to the carriage 3 (see FIG. 2). The pulley 19 is attached to an output shaft of the carriage motor 4 and the pulley 20 is rotatably attached to the supporting frame 16. The guide shaft 17 slidably supports the carriage 3 so as to guide the carriage 3 in the primary scanning direction PS. An ink cartridge 21 containing various kinds of ink to be supplied to the printing head 2 is mounted on the carriage 3.

Although not shown, a plurality of nozzles (not shown) are provided in the printing head 2. Further, a plurality of piezoelectric elements (not shown) which have excellent responsibility as a kind of an electrostrictive element are provided in the printing head 2, for example, to correspond to the individual nozzles. More specifically, the piezoelectric elements are disposed at positions being in contact with a wall face forming ink passages (not shown). When the wall face is pressed by the operation of the piezoelectric element, the printing head 2 ejects ink drops from the nozzle provided at the end of the ink passage. More specifically, the ink head 2 ejects ink from the ink ejecting face 2*a*. The ink cartridge 21 contains, for example, dye-based ink with a good color appearance property for excellent image quality or pigment-based ink with excellent water resistibility or light resistibility.

The sheet feeding roller 12 is connected to the sheet feeding motor 5 through a gear (not shown) and is driven by the sheet feeding motor 5. As shown in FIG. 2, the hopper 11 is a plate-shaped member on which the printing medium P is mounted and can pivot about a pivot shaft supporting the upper portion of the hopper 11 by a cam mechanism (not shown). The pivot causes the lower end of the hopper 11 to be elastically brought into contact with the sheet feeding roller 12 or be separated from the sheet feeding roller 12. The separating pad 13 is formed of a member having a high friction coefficient and is disposed at a position facing the sheet feeding roller 12. When the sheet feeding roller 12 rotates, the surface of the sheet feeding roller 12 is pressed against the separating pad 13. Therefore, when the sheet feeding roller 12 rotates, an uppermost printing medium P mounted on the hopper 11 passes through a nip made between the separating pad 13 and the surface of the sheet feeding roller 12 and is transported to a downstream side, while transporting of the second or lower printing media P is blocked by the separating pad 13.

The sheet transporting roller 6 is connected to the sheet feeding motor 5 directly or through a gear (not shown). As shown in FIG. 2, a sheet feeding follower roller 23 for transporting the printing medium P together with the sheet transporting roller 6 is provided in the printer 1. The sheet feeding follower roller 23 is held on the downstream side of a follower roller holder 24 capable of pivot about a pivot shaft 25. The follower roller holder 24 is urged (counterclockwise in FIG. 2) by a spring (not shown) such that the sheet feeding follower roller 23 is always subjected to urging force directed toward the sheet transporting roller 6. When the sheet transporting roller 6 is driven, the sheet feeding follower roller 23 also rotates together with the sheet transporting roller 6.

As shown in FIG. 2, the sheet detector 14 comprises a detection lever 26 and a photoelectric sensor 27 and is provided in the vicinity of the driving roller holder 24. The detection lever 26 can pivot about a pivot center 28. When the printing medium P completely passes by the lower side of the detection lever 26, the detection lever 26 pivots counterclockwise in this figure. When the detection lever 26 pivots, light from a light emitting element (not shown) to a light receiving element (not shown) of the photoelectric sensor 27 is blocked, thereby detecting the passage completion of the printing medium P.

The sheet ejecting roller 15 is disposed on the downstream side of the printer 1 and is connected to the sheet feeding motor 5 through a gear (not shown). As shown FIG. 2, a sheet ejecting follower roller 29 for ejecting the printing medium P together with the sheet ejecting roller 15 is provided in the printer 1. Similar to the sheet feeding follower roller 23, the sheet ejecting follower roller 29 is always subjected to urging force directed to the sheet ejecting roller 15 by a spring (not shown). Therefore, when the sheet ejecting roller 15 is driven, the sheet ejecting follower roller 29 also rotates together with the sheet ejecting roller 15.

As shown in FIGS. 2 and 3, the printer 1 comprises a linear encoder 33 having a linear scale 31 and a photoelectric sensor 32 as a position detector for detecting the speed of the carriage 3 or the position of the carriage 3 in the primary scanning direction PS. Further, as shown in FIG. 3, the printer 1 includes a rotary encoder 36 having a rotary scale 34 and a photoelectric sensor 35 as a position detector for detecting the transported speed of the printing medium P or the position of the printing medium P in the secondary scanning direction SS (more specifically, the rotation position or the rotation speed of the sheet transporting roller 6). Position detection signals output from the linear encoder 33 and the rotary encoder 36 are input to a controller 37 as shown in FIG. 3, and the controller 37 performs various kinds of control of the printer 1. In FIG. 1, for convenience, the linear scale 31 and so on are omitted.

The photoelectric sensor 32 constituting the linear encoder 33 includes a light emitter 41 and a light receiver 42, as shown in FIGS. 2 and 3. The photoelectric sensor 32 is fixed to the rear face of the carriage 3. The linear scale 31 is formed of a thin plate made of, for example, a transparent resin, or a thin and elongated stainless steel plate. The linear scale 31 is attached to the supporting frame 16 in parallel with the primary scanning direction PS. In the linear scale 31, light transmitting portions (not shown) for transmitting light from the light emitter 41 of the photoelectric sensor 32 and light blocking portions (not shown) for blocking light from the light emitter 41 are alternately formed along the longitudinal direction thereof. When the carriage 3 moves, the linear scale 31 relatively moves between the light receiver 42 and the light emitter 41 of the photoelectric sensor 32. According to the relative movement of the linear scale 31, the photoelectric sensor 32 outputs a position detection signal having a rectangular waveform with a cycle according to the moving speed of the carriage 3.

As shown in FIG. 3, the photoelectric sensor 35 constituting the rotary encoder 36 has a light emitter 81 and a light receiver 82, and is fixed to, for example, the main body chassis 8 through a bracket (not shown). The rotary scale 34 is formed of a circular thin stainless steel plate or a circular thin transparent resin plate. The rotary scale 34 in this embodiment is attached to the sheet transporting roller 6 and rotates integrally with the sheet transporting roller 6. In other words, when the sheet transporting roller 6 rotates 360° degrees, the rotary scale 34 also rotates 360° degrees. In the rotary scale 34, a plurality of light transmitting units (not shown) for transmitting light from the light emitter 81 of the photoelectric sensor 35 and a plurality of light blocking units (not shown) for blocking light from the light emitter 81 are alternately formed along the circumference thereof. When the sheet transporting roller 6 rotates, the rotary scale 34 relatively rotates between the light receiver 82 and the light emitter 81 of the photoelectric sensor 35. According to the relative rotation of the rotary scale 34, the photoelectric sensor 35 outputs a position detection signal having a rectangular waveform with a cycle according to the rotation speed of the sheet transporting roller 6. In this embodiment, the photoelectric sensor 35 outputs a position detection signal for a resolution of 180 dpi.

Figure 4:
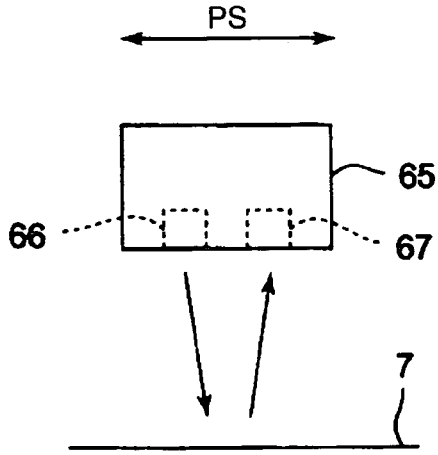
FIG. 4 is a schematic view of a sheet edge detector in the printer.

As shown in FIGS. 2 to 4, the printer 1 further includes an edge detector 65 for detecting the edge of, for example, the printing medium P in the primary scanning direction PS (the moving direction of the carriage 3). The edge detector 65 is fixed to the carriage 3, as shown in FIG. 2. More specifically, the edge detector 65 is fixed to the lower face of the carriage 3 on the upstream side of the printing head 2 in the secondary scanning direction SS (on the right side of FIG. 2). Further, as shown in FIG. 3, the edge detector 65 is fixed to the away position AP side of the carriage 3 in the primary scanning direction PS. As shown in FIG. 4, the edge detector 65 includes a light emitter 66 for emitting light toward the platen 7 and a light receiver 67 receiving light that is emitted from the light emitter 66 and then reflected by the platen 7. In this edge detector 65, according to the movement of the carriage 3 in the primary scanning direction PS, the light emitter 66 emits light toward the platen 7 and the light receiver 67 receives the light reflected by the platen 7. Then, the edge detector 65 outputs to the controller 37 an edge detection signal having a level corresponding to the amount of light received by the light receiver 67 (see FIG. 3).

Figure 5:
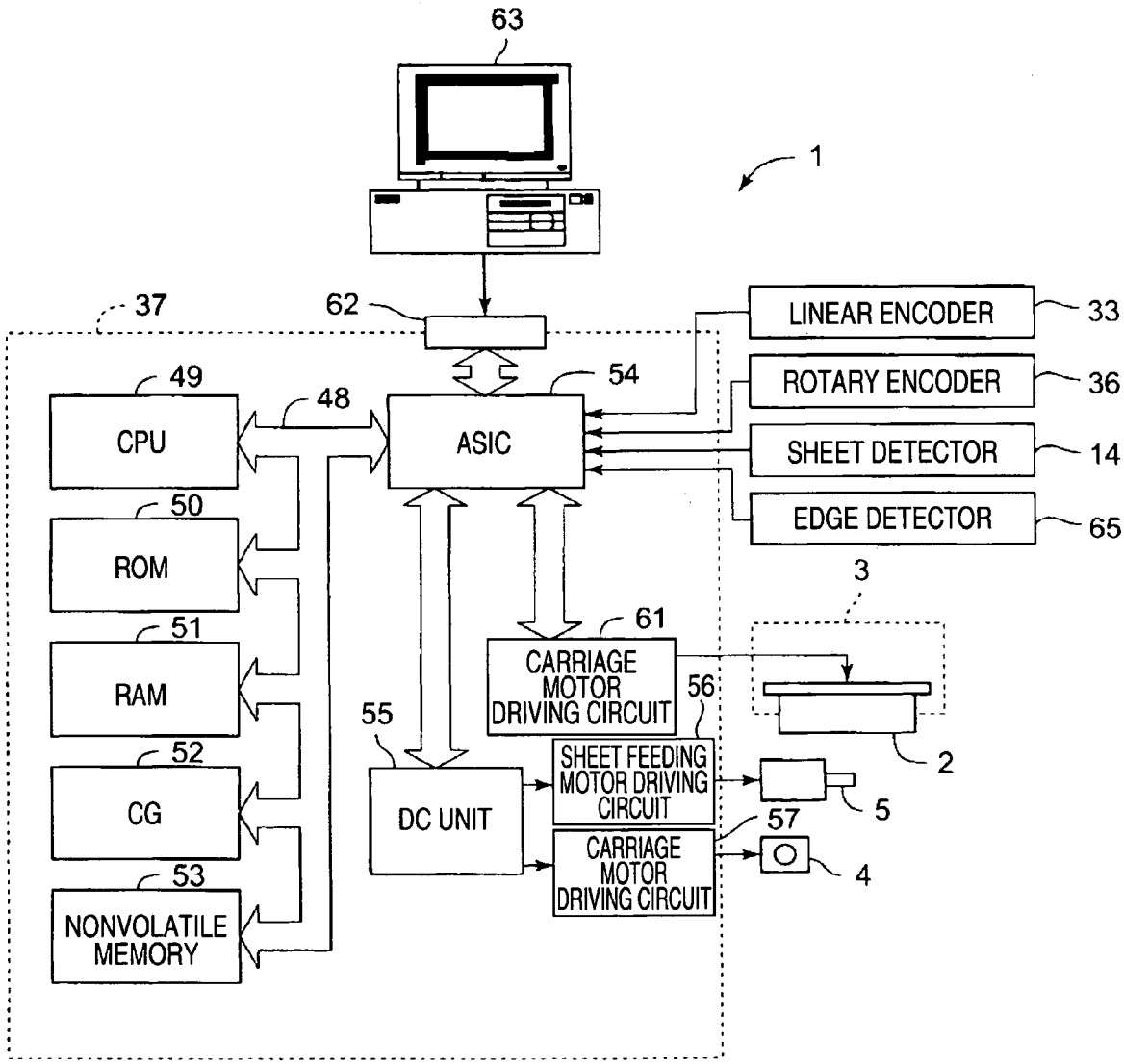
FIG. 5 is a block diagram showing a control system in the printer.

As shown in FIG. 5, the controller 37 includes a bus 48, a CPU 49, a ROM 50, a RAM 51, a character generator (CG) 52, a nonvolatile memory 53, an ASIC 54, a DC unit 55, a sheet feeding motor driving circuit 56, a carriage motor driving circuit 57, a head driving circuit 61, etc.

The CPU 49 performs an operating process for executing a control program of the printer 1 stored in, for example, the ROM 50 or the nonvolatile memory 53, or other necessary operating processes. The ROM 50 stores a control program for controlling the printer 1, data necessary for the processes, and so on.

The RAM 51 temporarily stores, for example, a program being executed by the CPU 49 or data being operated. The CG 52 stores an extended dot pattern corresponding to a print signal input to the ASIC 54. The nonvolatile memory 53 stores various kinds of data required to be held after the printer 1 is deactivated.

The ASIC 54 performs, for example, the control of the carriage motor 4 and the sheet feeding motor 5 or the control of the printing head 2 through the DC unit 55 or the head driving circuit 61. This ASIC 54 is provided with a parallel interface circuit and can receive a print signal supplied from, for example, a host computer through an interface 62. As shown in FIG. 5, the ASIC 54 is supplied with signals from the linear encoder 33, the rotary encoder 36, and various detectors, such as the sheet detector 14 and the edge detector 65.

The ASIC 54 computes the position of the carriage 3 on the basis of the number of rectangular pulses of the position detection signal (that is, digital signal) input from the linear encoder 33 and computes the speed of the carriage 3 on the basis of a pulse interval of the position detection signal. Further, the ASIC 54 computes the rotation position of the sheet transporting roller 6 on the basis of the number of rectangular pulses of the position detection signal (that is, digital signal) input from the rotary encoder 36 and computes the rotation speed of the sheet transporting roller 6 on the basis of a pulse interval of the position detection signal. Furthermore, the ASIC 54 sets a threshold to a sheet detection signal from the sheet detector 14 and detects the passage of the printing medium P fed into the printer 1 on the basis of the threshold and the sheet detection signal. In addition, the ASIC 54 sets a threshold to an edge detection signal from the edge detector 65 and detects the edge of the printing medium P in the primary scanning direction PS on the basis of the threshold and the edge detection signal. A method of detecting the edge of the printing medium P will be described later in detail.

The DC unit 55 is composed of a control circuit for controlling the speed of the carriage motor 4 or the sheet feeding motor 5, which is a DC motor. This DC motor 55 performs various operations for controlling the speed of the carriage motor 4 or the sheet feeding motor 5 on the basis of an operation instructing signal transmitted from the ASIC 54 and outputs a motor control signal to the sheet feeding motor driving circuit 56 or the carriage motor driving circuit 57 on the basis of the operation results. In this embodiment, a PID control method of controlling the current rotation speed of the carriage motor 4 or the sheet feeding motor 5 to be converged to a target rotation speed by a combination of proportional control, integral control, and derivative control is used as a method of controlling the carriage motor 4 and the sheet feeding motor 5.

The sheet feeding motor driving circuit 56 drives the sheet feeding motor 5 on .the basis of the motor control signal from the DC unit 55. In this embodiment, a PWM (pulse width modulation) method is used as an example of a method of controlling the sheet feeding motor 5, and the sheet feeding motor driving circuit 56 outputs a PWM driving signal. Similarly, the carriage motor driving circuit 57 also drives the carriage motor on the basis of the motor control signal from the DC unit 55. In this embodiment, the carriage motor 4 is also driven by the PWM control method.

The head driving circuit 61 drives the nozzles (not shown) of the printing head 2 on the basis of, for example, a control instruction transmitted from the CPU 49 or the ASIC 54.

The bus 48 is a signal line for connecting the above-mentioned individual components of the controller 37. The CPU, the ROM 50, the RAM 51, the CG 52, the nonvolatile memory 53, and the ASIC 54 are connected to one another by the bus 48 so as to transmit and receive data thereamong.

Figure 6:
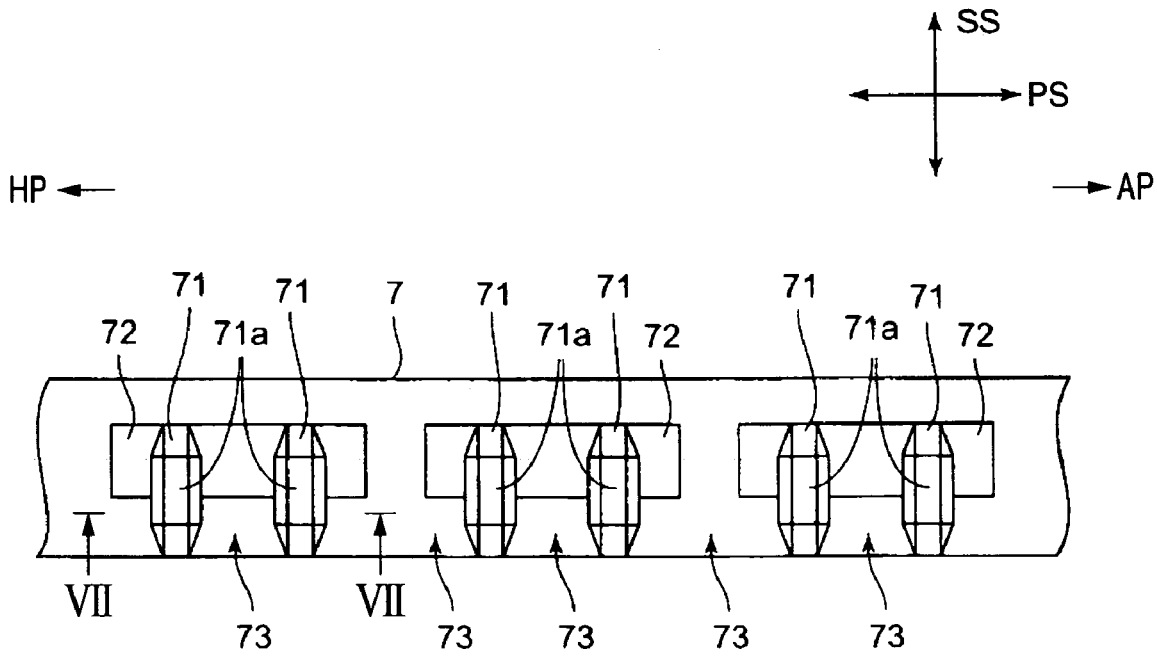
FIG. 6 is a partial plan view of a platen in the printer.

FIG. 6 shows a portion of the platen 7. For convenience, the left side thereof is referred to as the home position HP side and the right side thereof is referred to as the away position AP side. Also, a direction from the lower side to the upper side of this figure is referred to as the transported direction of the printing medium P.

Figure 7:
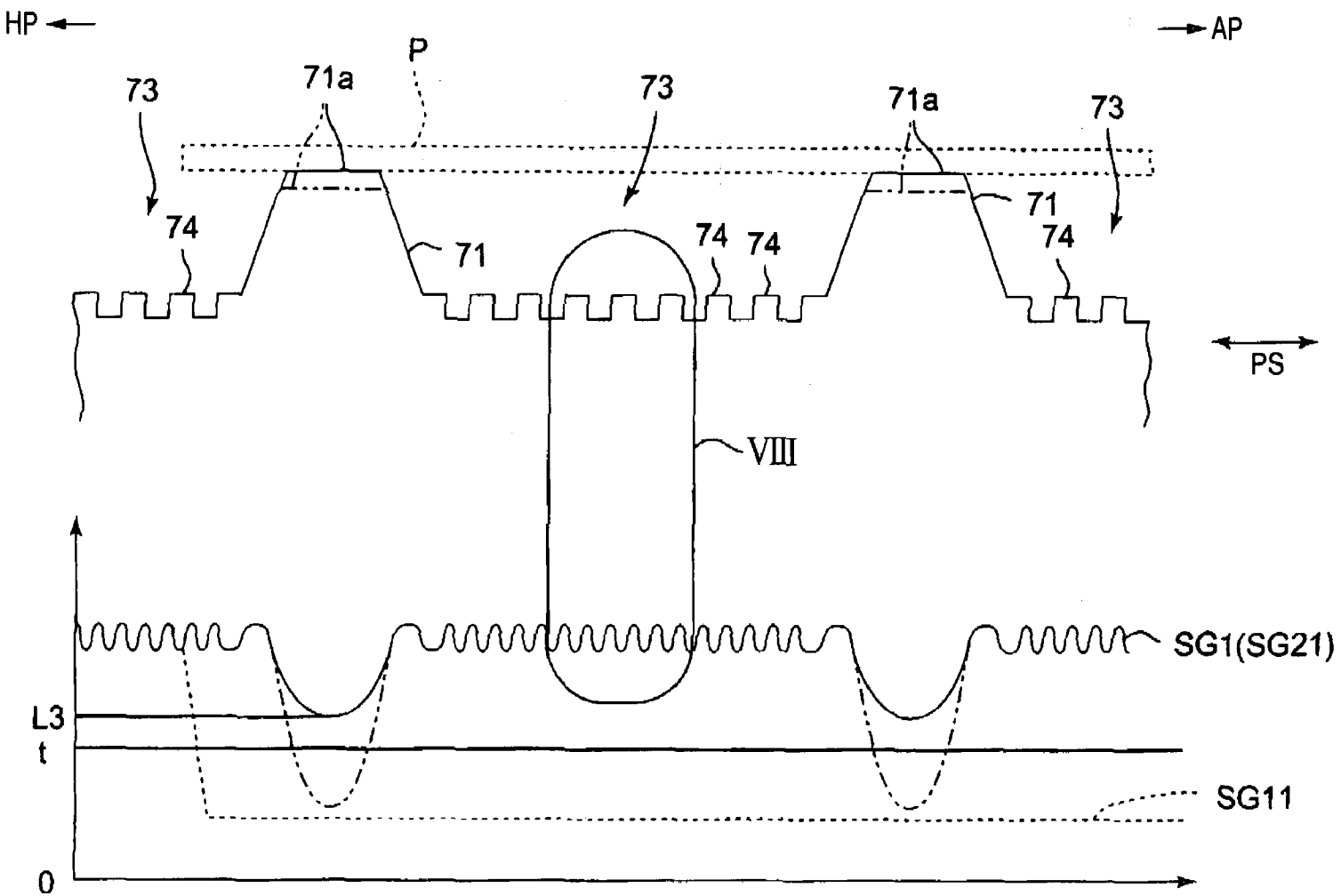
FIG. 7 is a diagram showing a relationship between the shapes of the platen (cross sectional shape along the line VII-VII in FIG. 6) and signals output from the sheet edge detector.

As shown in FIG. 6, the platen 7 has a plurality of first protrusions 71 for supporting the printing medium P when printing is performed on the printing medium P (that is, when the printing head 2 ejects ink onto the printing medium P), and ink absorbers 72 for absorbing the ink. Further, groove portions 73 are formed between the first protrusions 71. As shown in FIG. 7, in the groove portion 73, a plurality of second protrusions 74 smaller than the first protrusions 71 are formed on the upstream side (the lower side of FIG. 6) of the ink absorbers 72 relative to the secondary scanning direction SS. Specifically, the plurality of second protrusions 74 are arrayed in the primary scanning direction PS at a portion on which light is emitted from the light emitter 66 of the edge detector 65 fixed in the carriage 3 according to the movement of the carriage 3.

The first protrusion 71 has at the top thereof a horizontal supporting face 71*a* on which the printing medium P is mounted. In the first protrusion 71, both sides of the supporting face 71*a* in the primary scanning direction PS and both sides of the supporting face 71*a* in the secondary scanning direction SS are inclined to the bottom portion of the first protrusion 71 such that the first protrusion 71 is widen toward the bottom portion thereof. The ink absorber 72 is provided to absorb ink drops of ink ejected from the printing head 2 that has not been impacted on the printing medium P. This ink absorber 72 is formed of, for example, a water-absorbing sponge.

Figure 8:
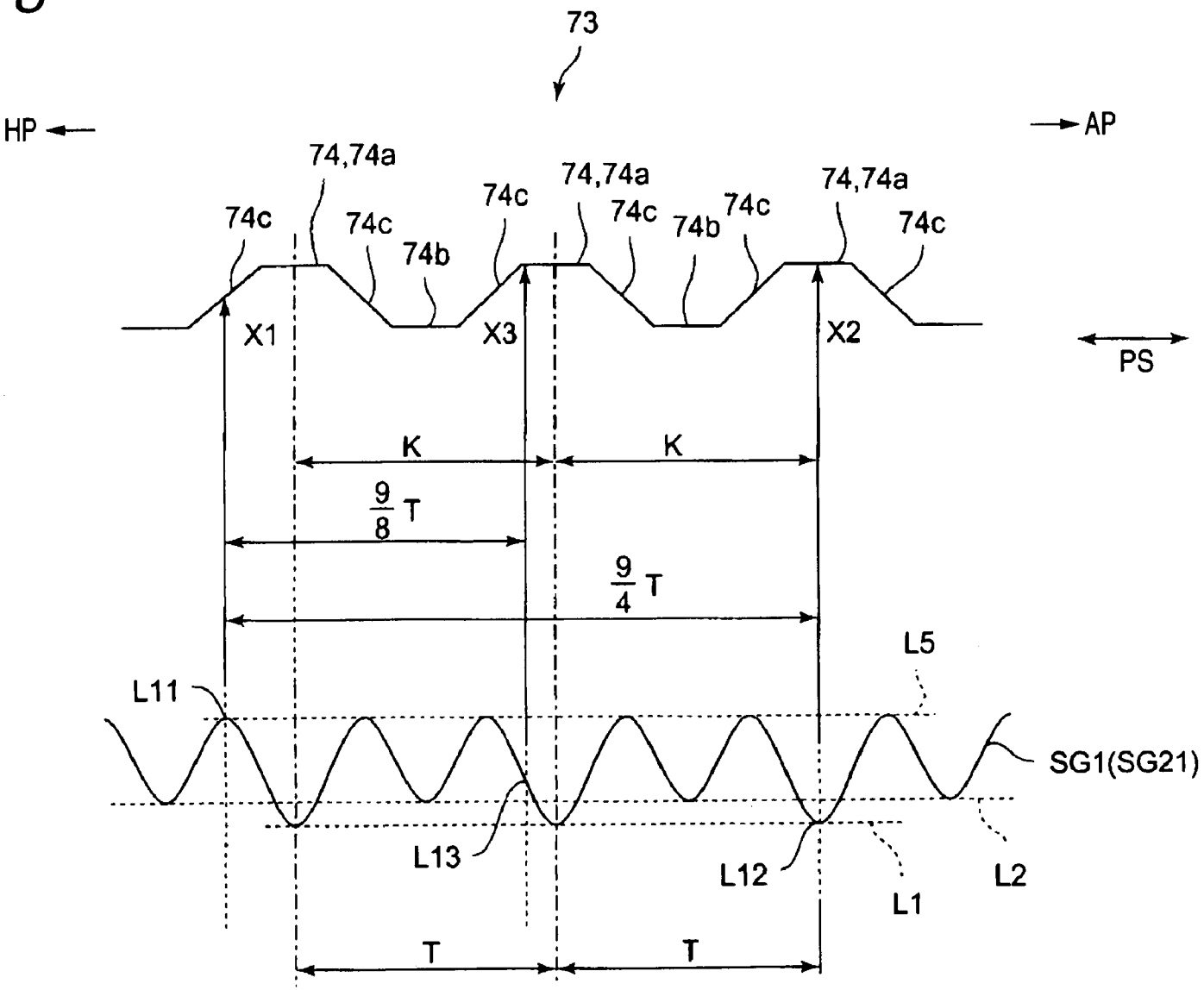
FIG. 8 is a diagram showing an enlarged view of the part VIII in FIG. 7.

As shown in FIG. 8, the second protrusion 74 includes: a first flat face 74*a* formed at the top thereof; second flat faces 74*b* between adjacent second protrusions 74; and slope faces 74*c* inclined such that the protrusion 74 is widen from the first flat face 74*a* toward the second flat faces 74*b*. The first flat face 74*a*, the second flat faces 74*b*, and the slope faces 74*c* have substantially the same width in the primary scanning direction PS. Further, the second protrusions 74 are formed on the groove portion 73 at regular interval K. For example, the regular interval K is 2 mm and the first flat face 74*a*n, the second flat faces 74*b*, and the slope faces 74*c* all have a width of 0.5 mm. Furthermore, the first flat face 74*a* and the second flat faces 74*b* are formed in parallel with the supporting faces 71*a*.

As described above, in order to detect the edge of the printing medium P in the primary scanning direction PS, the light emitter 66 of the edge detector 65 emits light according to the movement of the carriage 3 toward the platen 7, and the light receiver 66 receives the light reflected by the platen 7 and outputs to the controller 37 an edge detection signal having a level according to the amount of the received light. When the printing medium P is mounted on the platen 7, the edge detector 65 outputs an edge detection signal SG1, as shown by a solid line in FIG. 7. In other words, the edge detector 65 outputs an edge detection signal SG1 having a substantially sine-wave shape of which the level varies according to the shape of, for example, the first protrusion 71 or the second protrusion 74, as shown by the solid line in FIG. 7. The edge detection signal SG1 is a signal of which the level becomes lower as the amount of light received by the light receiver 67 increases.

More specifically, since light from the light emitter 66 is reflected by the first flat faces 74*a* and the second flat faces 74*b* of the groove portions 73 and thus it is easy for the reflected light to be returned to the light receiver 67, as shown in FIG. 8, in portions corresponding to the first flat faces 74*a* and the second flat faces 74*b*, the edge detection signal SG1 becomes a low level. Since the light from the light emitter 66 is diffusely reflected by the slope faces 74*c* of the groove portions 73 and thus it is difficult for the diffusely reflected light to be returned to the light receiver 67, in portions corresponding to the slope faces 74*c*, the edge detection signal SG1 becomes a high level. Similarly, in a portion corresponding to the supporting face 71*a*, the edge detection signal SG1 becomes the low level, and in portions corresponding to the slope faces inclined from both sides of the supporting face 71*a* in the primary scanning direction PS toward the bottom portion of the first protrusion 71, the edge detection signal SG1 becomes the high level.

Further, since the first flat face 74*a* is closer to the edge detector 65 than the second flat face 74*b*, a larger amount of light is reflected by the first flat face 74*a* than the second flat face 74*b* such that a large amount of light is incident on the light receiver 67. Therefore, as shown in FIG. 8, a signal level L1 of the edge detection signal SG1 in a portion corresponding to the center of the first flat face 74*a* in the primary scanning direction PS is lower than a signal level L2 of the edge detection signal SG1 in a portion corresponding to the center of the second flat face 74*b* in the primary scanning direction PS. Also, since the supporting face 71*a* is closer to the edge detector 65 than the first flat face 74*a*, as shown in FIG. 7, a signal level L3 of the edge detection signal SG1 in a portion corresponding to the center of the supporting face 71*a* in the primary scanning direction PS is lower than the signal level L1 of the edge detection signal SG1 in a portion corresponding to the center of the first flat face 74*a* in the primary scanning direction PS.

Here, as shown in FIG. 8, the level of the edge detection signal SG1 in a portion corresponding to the groove portion 73 varies with a constant cycle T corresponding to the regular interval K at which the second protrusions 74 are formed. In other words, when the signal level of the edge detection signal SG1 in a portion corresponding to the center of the slope face 74*c* in the primary scanning direction PS is a signal level L5, a portion of the edge detection signal SG1 corresponding to the groove portion 73 varies in the order of the signal level L1, the signal level L5, the signal level L2, the signal level L5, and the signal level L2 with a constant cycle T corresponding to the regular interval K.

Further, in order to detect the edge of the printing medium P in the primary scanning direction PS, as shown in FIG. 7, a prescribed threshold (edge detection threshold) t is set to the edge detection signal SG1. As shown in FIG. 7, a value lower than the level L3 of the edge detection signal SG1 in a portion corresponding to the supporting face 71*a* is set as the threshold t. Then, as shown by a dashed line in FIG. 7, when the printing medium P is mounted on the supporting faces 71*a* during the printing of the printing medium P, the level of the edge detection signal SG1 in a portion corresponding to the printing medium P is lower than the threshold t, as an edge detection signal SG11 shown by a chain line in FIG. 7. When variation occurs such that the level of the edge detection signal SG11 goes across the threshold t, it is possible to detect the edge of the printing medium P in the primary scanning direction PS. A method of setting the threshold t will be described below in detail.

In the printer 1 having the above-mentioned configuration, the carriage 3 driven by the carriage motor 4 reciprocates in the primary scanning direction PS while the printing medium P introduced from the hopper 11 into the printer 1 by the sheet feeding roller 12 or the separating pad 13 is transported in the secondary scanning direction SS by the sheet transporting roller 6 rotated by the sheet feeding motor 5. When the carriage 3 reciprocates, the printing head 2 ejects ink drops, thereby performing printing on the printing medium P. When printing on the printing medium P is finished, the printing medium P is ejected to the outside of the printer 1 by the sheet ejecting roller 15.

When the carriage 3 moves, the linear encoder 33 outputs the position detection signal. The ASIC 54 receives the output position detection signal and detects the position or speed of the carriage 3 from the received position detection signal. Then, various control of the printer 1 is performed on the basis of the detected position or speed of the carriage 3. Further, when the carriage 3 moves, the edge detector 65 outputs the edge detection signal SG1. The ASIC 54 receives the output edge detection signal SG1 and detects the edge of the printing medium P in the primary scanning direction PS from the received edge detection signal SG1 and the threshold t set to the edge detection signal SG1. Then, various control of the printer 1 is performed on the basis of the detection result of the edge of the printing medium P. For example, on the basis of the detection result of the edge of the printing medium P, for printing on the edge of the printing medium P, control of the printing head 2 (control of, for example, the amount of ink ejected by the printing head 2 or ejection timings) is performed by the head driving circuit 61.

Furthermore, the ASIC 54 detects, for example, the rotation position or rotation speed of the sheet transporting roller 6 from the position detection signal output according to the rotation of the sheet transporting roller 6 from the rotary encoder 36, and then various control is performed on the printer 1 on the basis of the detection result. In addition, the ASIC 54 detects the passage of the printing medium P introduced into the printer 1 from the sheet detection signal from the sheet detector 14 and the threshold set to the sheet detection signal and then various control is performed on the printer 1 the basis of the detection result.

As described above, in order to perform the control of the printing head 2, etc., the detection of the edge of the printing medium P in the primary scanning direction PS is performed. In order to detect the edge of the printing medium P, a method of setting the threshold (edge detection threshold) t to the edge detection signal SG1 will be described below with reference to FIG. 9.

When the carriage 3 moves in a state where no printing medium P is mounted on the first protrusions 71, the light emitter 66 emits light, the platen 7 (specifically, the first protrusions 71 and the portions of the groove portions 73 in which the second protrusions 74 are formed) reflects the emitted light, and the light receiver 67 receives the reflected light. In the case, the setting of the threshold t is performed on the basis of an output signal of the edge detector 65 output according to the amount of light received the light receiver 67. While the output signal of the edge detector 65 is a signal that is substantially the same as the edge detection signal SG1 shown by the solid line in FIG. 7, hereinafter, the output signal used for setting the threshold t is represented as a threshold setting signal SG21.

The setting or updating of the threshold t is performed, for example, when the printer 1 is activated. A case of setting the threshold t when the printer 1 is activated will be described below. However, a time for setting or updating of the threshold t is not limited to the time when the printer 1 is activated. The setting or updating of the threshold t may be performed when a prescribed time period elapses after the activation or after printing on a prescribed number of sheets is finished. Accordingly, it is possible to setting the threshold t in view of chronological changes such as variation in reflectance of the platen 7 or a stain on the edge detector 65.

Figure 9:
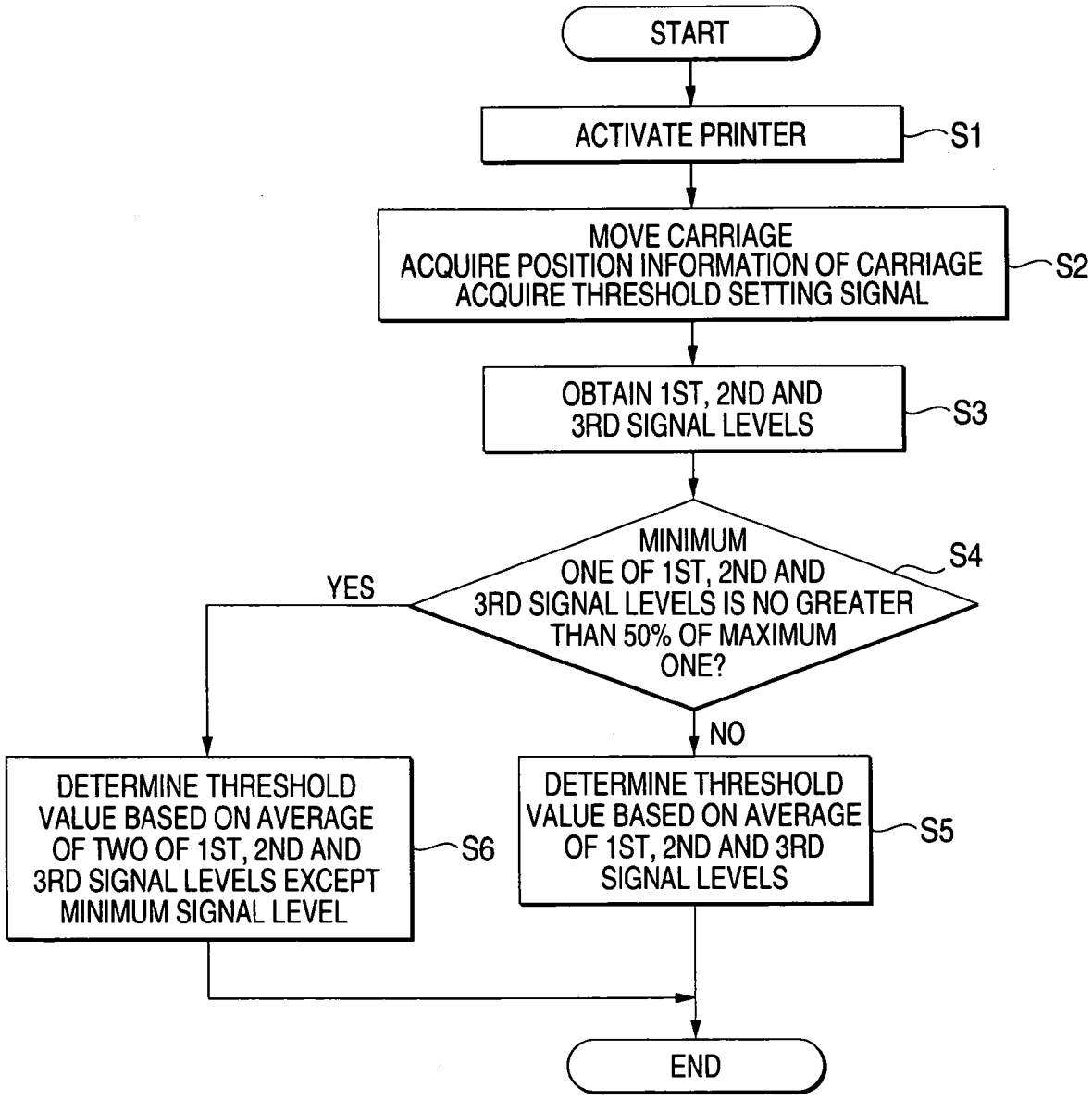
FIG. 9 is a flowchart showing how to set a threshold for the signals output from the sheet edge detector.

As shown in FIG. 9, when the printer 1 is activated (Step S1), the carriage 3 reciprocates in a state where no printing medium P is mounted on the first protrusions 71 (that is, in a state where no printing medium P is introduced into the printer) (Step S2). In Step S2, according to the movement of the carriage 3, the linear encoder 33 outputs the position detection signal, and the ASIC 54 receives the position detection signal and counts the number of pulses of the received position detection signal. That is, the ASIC 54 acquires information on the position of the carriage 3. Further, in Step S2, according to the movement of the carriage 3, the edge detector 65 outputs the threshold setting signal SG21 and the ASIC 54 receives the output threshold setting signal SG21.

In this embodiment, the threshold t is set on the basis of three signal levels of the threshold setting signal SG21 when light which is emitted by the light emitter 66 and then reflected at three positions of the groove portion 73 is incident on the light receiver 67. More specifically, as shown in FIG. 8, the threshold t is set on the basis of a first signal level L11 of the threshold setting signal SG21 when a light component reflected at a position approximate to the center of a slope face 74*c* (hereinafter, this position is referred to as a first position X1) is incident on the light receiver 67, a second signal level L12 of the threshold setting signal SG21 when a light component reflected at a position approximate to the center of a first flat face 74*a* (hereinafter, this position is referred to as a second position X2) is incident on the light receiver 67, and a third signal level L13 of the threshold setting signal SG21 when a light component reflected at a position approximate to the left edge of the first flat face 74*a* shown in FIG. 8 (hereinafter, this position is referred to as a third position X3) is incident on the light receiver 67. That is, the threshold t is set using the signal level L5, the signal level L1, and an intermediate level between the signal level L5 and the signal level L1 as the signal levels L11, L12, and L13, respectively.

Consequently, when the threshold setting signal SG21 is input to the ASIC 54, the ASIC 54 obtains the first signal level L11, the second signal level L12, and the third signal level L13 of the threshold setting signal SG21 (Step S3).

In this case, the first position X1, the second position X2, and the third position X3 are set according to the position detection signal from the linear encoder 33. That is, the number of pulses of the position detection signal corresponding to the first position X1 (hereinafter, referred to as a first number of pulses), the number of pulses of the position detection signal corresponding to the second position X2 (hereinafter, referred to as a second number of pulses), and the number of pulses of the position detection signal corresponding to the third position X3 (hereinafter, referred to as a third number of pulses) are stored in the ASIC 54 beforehand. Then, the signal levels of the threshold setting signal SG21 when the number of pulses of the position detection signal input from the linear encoder 33 according to the movement of the carriage 3 is equal to the number of first pulses to the number of third pulses become the signal levels of the threshold setting signal SG21 when the light components reflected at the first position X1 to the third position X3 are incident on the light receiver 67, respectively.

For this reason, in Step S3, the ASIC 54 obtains the signal levels of the threshold setting signal SG21 when the number of pulses of the position detection signal input from the linear encoder 33 according to the movement of the carriage 3 is equal to each of the number of first pulse to the number of third pulses, as the first signal level L11, the second signal level L12, and the third signal level L13, respectively.

For example, in this embodiment, when it is assumed that the first number of pulses, which is the number of pulses corresponding to the first position X1, is Y, the second number of pulses becomes (Y+32) and the third number of pulses becomes (Y+16). As described above, in this embodiment, since the resolution of the position detection signal output from the linear encoder 33 is 180 dpi, the interval between the first position X1 and the second position X2 becomes, for example, 4.515 nm (=25.4 (inches)/180 (dpi)×32 (pulses)) and the interval between the first position X1 and the third position X3 becomes, for example, 2.257 mm (=25.4 (inches)/180 (dpi)×16 (pulses)).

Also, the positions of the groove portion 73 corresponding to the first number of pulses to the third number of pulses become the first position X1 to the third position X3, respectively. For this reason, according to component accuracy of the platen 7 and the accuracy of assembly of the platen 7 into the main body of the printer 1, the first position X1 may not be the position approximate to the center of the slope face 74*c*, the second position X2 may not be the position approximate to the center of the first flat face 74*a*, and the third position X3 may not be the position approximate to the left edge of any one first flat face 74*a* shown in FIG. 8. That is, practically, the first position X1 to the third position X3 may be positions deviating from the positions shown in FIG. 8 to the home position HP side or the away position AP side. Therefore, the first signal level L11 is not always coincident with the signal level L5, and similarly, the second signal level L12 is not always coincident with the signal level L1.

However, in this embodiment, as shown in FIG. 8, the interval between the first position X1 and the second position X2 is constant. That is, the first signal level L11 and the second signal level L12 become signal levels of the threshold setting signal SG21 at two points separated by about 9/4T thereon. For this reason, as shown in FIG. 8, when the first position X1 is a position approximate to the center of the slope face 74*c*, the second position X2 is a position approximate to the center of the first flat face 74*a*. However, for example, when the first position X1 is a position approximate to the center of the first flat face 74*a*, the second position X2 may be a position approximate to the center of the slope face 74*c*.

Therefore, in a case where the first position X1 is a position approximate to the center of the slope face 74*c* and the second position X2 is a position approximate to the center of the first flat face 74*a*, when the carriage 3 moves from a position corresponding to the first position X1 to, for example, the away position AP side, the level of the threshold setting signal SG21 exhibits a tendency to be lower than the first signal level L11. When the carriage 3 moves from a position corresponding to the second position X2 to the away position AP side, the level of the threshold setting signal SG21 exhibits a tendency to be higher than the second signal level L12.

On the other hand, in a case where the first position X1 is a position approximate to the center of the first flat face 74*a* and the second position X2 is a position approximate to the center of the slope face 74*c*, when the carriage 3 moves from the position corresponding to the first position X1 to, for example, the away position AP side, the level of the threshold setting signal SG21 exhibits a tendency to be higher than first the signal level L11. In addition, when the carriage 3 moves from the position corresponding to the second position X2 to the away position AP side, the level of the threshold setting signal SG21 exhibits a tendency to be lower than the second signal level L12.

That is, in this embodiment, in a case where the level of the threshold setting signal SG21 when the carriage 3 moves from the position corresponding to the first position X1 to one side exhibits a tendency to be lower than the first signal level L11, when the carriage 3 moves from the position corresponding to the second position X2 to one side, the level of the threshold setting signal SG21 exhibits a tendency to be higher than the second signal level L12. Also, in a case where the level of the threshold setting signal SG21 when the carriage 3 moves from the position corresponding to the first position X1 to one side exhibits a tendency to be higher than the first signal level L11, when the carriage 3 moves from the position corresponding to the second position X2 to one side, the level of the threshold setting signal SG21 exhibits a tendency to be lower than the second signal level L12. As described above, in this embodiment, when one of the first signal level L11 and the second signal level L12 becomes higher, the other signal level becomes lower.

In this embodiment, as shown in FIG. 8, the third signal level L13 becomes the signal level of the threshold setting signal SG21 at a point separated from a point corresponding to the first signal level L11 by about 9/8T. The third signal level L13 becomes an intermediate signal between the first signal level L11 and the second signal level L12.

When the three signal levels, that is, the first signal level L11 to the third signal level L13 are computed in Step S3, the ASIC 54 determines whether a signal level, which becomes 50% or less of the maximum signal level of the first signal level L11 to the third signal level L13, exists among the first signal level L11 to the third signal level L13 (Step 4).

When a signal level, which is 50% or less of the maximum signal level of the first signal level L11 to the third signal level L13, does not exist among the first signal level L11 to the third signal level L13, the ASIC 54 calculates the average of the three signal levels, that is, the first signal level L11 to the third signal level L13, and sets, for example, 60% of the average as the threshold t (Step S5).

Meanwhile, when a signal level, which is 50% or less of the maximum signal level of the first signal level L11 to the third signal level L13, exists among the first signal level L11 to the third signal level L13, the ASIC 54 determines that the signal level is an abnormal value due to existence of a foreign substance, such as paper, on the platen 7. Then, the ASIC 54 obtains two signal levels other than the signal level which is 50% or less of the maximum signal level, and sets, for example, 60% of the average as the threshold t (Step S6).

When the threshold t is set in Step S5 or S6, a series of operations for setting the threshold t is finished.

Due to the transfer of the printing medium P, as time goes on, the first protrusion 71 is worn down as shown by a dashed chain line in FIG. 7. When the first protrusion 71 is worn down, since the reflection area or reflectance of light from the light emitter 66 increases in the supporting face 71*a*, the signal level of the edge detection signal SG1 (the threshold setting signal SG21) is lower than the threshold t. For this reason, when the edge of the printing medium P is detected or when the threshold t is updated, it is preferable that the ASIC 54 performs a masking process on a portion of the edge detection signal SG1 (the threshold setting signal SG21) corresponding to the supporting face 71*a* and determines the relationship between the edge detection signal SG1 (the threshold setting signal SG21) and the threshold t.

As described above, in this embodiment, when one of the first signal level L11 and the second signal level L12 becomes higher, the other signal level becomes lower. More specifically, in a case where the level of the threshold setting signal SG21 when the carriage 3 moves from a position corresponding to the first position X1 to, for example, the away position AP side exhibits a tendency to be lower than the first signal level L11, when the carriage 3 moves from a position corresponding to the second position X2 to the away position AP side, the level of the threshold setting signal SG21 exhibits a tendency to be higher than the second signal level. On the other hand, in a case where the level of the threshold setting signal SG21 when the carriage 3 moves from the position corresponding to the first position X1 to, for example, the away position AP side exhibits a tendency to be higher than the first signal level L11, when the carriage 3 moves from the position corresponding to the second position X2 to the away position AP side, the level of the threshold setting signal SG21 exhibits a tendency to be lower than the second signal level.

In other words, in this embodiment, since the first flat face 74*a*, the second flat face 74*b*, and the slope face 74*c* are formed with substantially the same width in the moving direction of the carriage 3 and the threshold setting signal SG21 with the cycle T is output from the edge detector 65, in two points of the threshold setting signal SG21, which are points for obtaining the first signal level L11 and the second signal level L12 and are separated from each other by about 9/4T, when the threshold setting signal SG21 at one of the two points has a tendency to be higher, the threshold setting signal SG21 at the other point has a tendency to be lower. The threshold t is set on the basis of the first signal level L11 and the second signal level L12. Therefore, it is possible to reduce variation in the threshold t and to stably detect the edge of the printing medium P.

As described above, according to the component accuracy of the platen 7 or the accuracy of assembly of the platen into the main body of the printer 1, the first signal level L11 or the second signal level L12 actually computed may not be the signal level of the threshold setting signal SG21 when light reflected at the position approximate to the center of the slope face 74*c* or the first flat face 74*a* shown in FIG. 8 is incident on the light receiver 67. Even in this case, as the first signal level L11 becomes higher, the second signal level L12 becomes lower, and as the first signal level L11 becomes lower, the second signal level L12 becomes higher. Therefore, it is possible to offset variation in the first signal level L11 and variation in the second signal level L12. As a result, it is possible to reduce variation in the threshold t and to stably detect the edge of the printing medium P.

Particularly, in this embodiment, the threshold t is set on the basis of the three signal levels, that is, the first signal level L11, the second signal level L12, and the third signal level L13 which is the signal level of the threshold setting signal SG21 at a point separated from the point corresponding to the first signal level L11 by about 9/8T. Since the third signal level L13 becomes an intermediate level between the first signal level L11 and the second signal level 12, when the threshold t is set on the basis on the three signal levels, it is possible to set the threshold t having a small variation.

In this embodiment, when a signal level which is 50% or less the maximum signal level does not exist among the first signal level L11 to the third signal level L13, the threshold t is set on the basis of the average of the three signal levels, that is, the first signal level L11 to the third signal level L13. Therefore, it is possible to offset variation in the first signal level L11 and variation in the second signal level L12. Further, the calculation of the average makes it possible to reduce the influence of variation in the third signal level L13. Therefore, it is possible to effectively reduce variation in the threshold t. Furthermore, since the threshold t is set using not only the first signal level L11 and the second signal level L12 but also the third signal level L13 that is an intermediate level between the first signal level L11 and the second signal level L12, it is possible to stabilize the threshold t.

Meanwhile, in this embodiment, when a signal level which is 50% or less the maximum signal level exists among the first signal level L11 to the third signal level L13, the threshold t is set on the basis of the average of two signal levels other than the signal level that is an intermediate level between the first signal level L11 and the second signal level L12. Therefore, it is possible to eliminate the influence of the abnormal signal level and to effectively reduce variation in the threshold t.

Although one exemplary embodiments of the invention has been described in detail above, those skilled in the art will readily appreciated that many modifications are possible in the exemplary embodiments without materially departing from the novel teachings and advantages of the invention. Accordingly, all such modifications are intended to be included within the scope of the invention.

In the above-mentioned embodiment, the threshold t is set on the basis of the three signal levels, that is, the first signal level L11, the second signal level L12, and the third signal level L13. However, the threshold t may be set on the basis of, for example, two signal levels, that is, the first signal level L11 and the second signal level L12. Even in this case, it is possible to offset variation in the first signal level L11 and variation in the second signal level L12 and to reduce variation in the threshold t. Also, the threshold t may be set on the basis of four or more signal levels including not only the first signal level L11 to the third signal level L13 but also at least one signal level.

In the above-mentioned embodiment, the first signal level L11 and the second signal level L12 used for setting the threshold t are signal levels of the threshold setting signal SG21 at two points separated from each other by about 9/4T. However, the first signal level L11 and the second signal level L12 may be signal levels of the threshold setting signal SG21 at two points separated from each other by about $(1/4+n_1/2)T$ ($n_1$ is an integer equal to or greater than 0). In the case where the first signal level L11 and the second signal level L12 are signal levels of the threshold t at two points separated from each other by about $(1/4+n_1/2)T$, when the threshold signal SG21 at the point corresponding to one of the first and second levels has a tendency to be higher, the threshold signal SG21 at the point corresponding to the other level has a tendency to be lower. Therefore, it is possible to reduce variation in the threshold t.

In the above-mentioned embodiment, the third signal level L13 is the signal level of the threshold setting signal SG21 at a point separated from the point corresponding to the first signal level L11 by about 9/8T. However, the third signal level L13 may be a signal level of the threshold setting signal SG21 at a point separated from the point corresponding to the first signal level L11 by about $(1/8+n_2/2)T$ ($n_2$ is an integer equal to or greater than 0).

In the above-mentioned embodiment, the first flat face 74*a*, the second flat face 74*b*, and the slope face 74*c* have substantially the same width in the primary scanning direction PS. However, the first flat face 74*a*, the second flat face 74*b*, and the slope face 74*c* may have different widths in the primary scanning direction PS, or two of the first flat face 74*a*, the second flat face 74*b*, and the slope face 74*c* may have the same width in the primary scanning direction PS.

Also, at least one of the first flat face 74*a* and the second flat face 74*b* may be parallel with the supporting face 71*a*. Even in this case, when the threshold setting signal SG21 at a point corresponding to the first signal level L11 has a tendency to be higher, the threshold setting signal SG21 at a point corresponding to the second signal level L12 has a tendency to be lower. In addition, when the threshold setting signal SG21 at the point corresponding to the first signal level L11 has a tendency to be lower, the threshold setting signal SG21 at the point corresponding to the second signal level L12 has a tendency to be higher. When the threshold t is set on the basis of the first signal level L11 and the second signal level L22 having the above-mentioned relationship, it is possible to obtain the same advantages as that in the above-mentioned embodiment.

In the above-mentioned embodiment, when a signal level, which is 50% or less of the maximum signal level, does not exist among the first signal level L11 to the third signal level L13, the threshold t is set on the basis of the three signal levels, that is, the first signal level L11 to the third signal level L13. However, the threshold t may be set on the basis of the maximum, minimum, or intermediate signal level of the first signal level L11 to the third signal level L13.

In the above-mentioned embodiment, when a signal level, which is 50% or less of the maximum signal level, exists among the first signal level L11 to the third signal level L13, the threshold t is set on the basis of the average of two signal levels other than the signal level that is 50% or less of the maximum signal level. However, the threshold t may be set on the basis of one of two signal levels other than the signal level that is 50% or less of the maximum signal level.

Although the explanation is made as to the ink jet printer as an example of the liquid ejecting apparatus, the invention can also be applied to a facsimile apparatus, a copying apparatus etc. Further, the invention can be applied not only to the printing apparatus but also to an apparatus provided with a color material ejecting head used for manufacturing color filters for liquid crystal displays etc., an electrode material (conductive paste) ejecting head used for forming the electrodes of organic EL displays or field emission displays (FED) etc., a bio-organic material ejecting head used for manufacturing biochips, a sample ejecting head as an accurate pipette, and so on as the liquid ejection apparatus which ejects liquid from a liquid ejecting head toward a target medium thereby to land the liquid onto the target medium.

The disclosure of Japanese Patent Application No. 2005-331444 filed Nov. 16, 2006 including specification, drawings and claims is incorporated herein by reference in its entirety.

What is claimed is:

1. A liquid ejecting apparatus, comprising:

a liquid ejecting head, operable to eject liquid toward a target medium;

a platen, opposing the liquid ejecting head, and having a first region formed with a plurality of projections, wherein the projections include first projections and second projections having smaller sizes than the first projections; and the first region is a region in which the second protrusions are formed;

a first detector, including a light emitter operable to emit light toward the platen and a light receiver adapted to receive light reflected from the platen, the first detector operable to generate a detection signal in accordance with an amount of the light received by the light receiver; and a controller, operable to obtain the detection signal at a plurality of positions in the first region to determine a threshold value of the detection signal for detecting whether the target medium exists on the platen.

2. The liquid ejecting apparatus as set forth in claim 1, wherein:

the first projections are adapted to support the target medium.

3. The liquid ejecting apparatus as set forth in claim 1, wherein:

each of the second projections has a slope face.

4. The liquid ejecting apparatus as set forth in claim 1, wherein: signal levels of the detection signal obtained at the plurality of positions are different from each other.

5. The liquid ejecting apparatus as set forth in claim 4, wherein: the controller is operable to determine the threshold value based on an average of the signal levels.

6. The liquid ejecting apparatus as set forth in claim 1, further comprising:

a carriage, operable to carry the liquid ejecting head and the first detector in a first direction; and a position detector, operable to detect a position of the carriage in the first direction to determine the plurality of positions.

7. The liquid ejecting apparatus as set forth in claim 1, wherein:

the controller is operable to detect whether a foreign substance exists on the platen, based on a signal level of the detection signal, and is operable to determine the threshold value except the signal level indicative of the existence of the foreign substance.

8. The liquid ejecting apparatus as set forth in claim 1, wherein:

the plurality of positions include a first position at which a first signal level of the detection signal is obtained and a second position at which a second signal level of the detection signal is obtained;

the first signal level is greater than a signal level of the detection signal obtained at a position shifted from the first position by a first distance in the first direction; and the second signal level is less than a signal level of the detection signal obtained at a position shifted from the second position by the first distance in the first direction.

9. A method of determining a threshold value of a detection signal for detecting whether a target medium to which a liquid ejecting head ejects liquid exists on a platen which opposes the liquid ejecting head and has a first region formed with a plurality of projections, the method comprising:

emitting light from a light emitter to the platen;

receiving light reflected from the platen and generating a detection signal in accordance with an amount of the light received; and obtaining the detection signal at a plurality of positions in the first region to determine the threshold value, wherein the projections include first projections and second projections having smaller sizes than the first projections; and the first region is a region in which the second protrusions are formed.

10. The method as set forth in claim 9, wherein: signal levels of the detection signal obtained at the plurality of positions are different from each other.

11. The method as set forth in claim 10, wherein: the threshold value is determined based on an average of the signal levels.

12. The method as set forth in claim 9, further comprising:

carrying the liquid ejecting head, the light emitter and the light receiver in a first direction; and detecting a position of the carriage in the first direction to determine the plurality of positions.

13. The method as set forth in claim 9, further comprising:

detecting whether a foreign substance exists on the platen, based on a signal level of the detection signal; and determining the threshold value except the signal level indicative of the existence of the foreign substance.

14. The method as set forth in claim 9, wherein:

the plurality of positions include a first position at which a first signal level of the detection signal is obtained and a second position at which a second signal level of the detection signal is obtained;

the first signal level is greater than a signal level of the detection signal obtained at a position shifted from the first position by a first distance in the first direction; and the second signal level is less than a signal level of the detection signal obtained at a position shifted from the second position by the first distance in the first direction.

15. A liquid ejecting apparatus, comprising:

a liquid ejecting head, operable to eject liquid toward a target medium;

an opposing member, opposing the liquid ejecting head, and formed with a plurality of projections including first projections and second projections each having a smaller height dimension than a height dimension of each of the first projections;

a sensor, including a light emitter operable to emit light toward the opposing member and a light receiver adapted to receive light reflected from the opposing member, the sensor operable to generate a detection signal in accordance with an amount of the light received by the light receiver; and a controller, operable to obtain the detection signal at a plurality of positions in a first region in which the second protrusions are formed for detecting whether the target medium exists on a part of the opposing member opposing the sensor.

* * * * *